United States Patent [19]

Richins

[11] Patent Number: 4,827,566

[45] Date of Patent: May 9, 1989

[54] REMOVABLE HINGED SACK HANDLE

[76] Inventor: Blaine B. Richins, 1550 N. 170 East, Brigham City, Utah 84302

[21] Appl. No.: 163,726

[22] Filed: Mar. 3, 1988

[51] Int. Cl.[4] ..... B25G 3/18

[52] U.S. Cl. ..... 16/114 R; 16/DIG. 25; 383/13

[58] Field of Search ..... 16/110 R, 114 R, 114 B, 16/116 R, DIG. 24, DIG. 25, DIG.40; 383/13, 15, 26, 30

[56] References Cited

U.S. PATENT DOCUMENTS 3,550,838 12/1970 Hart ..... 383/13

3,657,765 4/1972 Geisinger ..... 16/114 B 4,112,541 9/1978 Tetradis ..... 383/30 X

*Primary Examiner*—Fred A. Silverberg

[57] ABSTRACT

This invention relates to a new and improved sack handle. The sack handle is comprised of a suitably-shaped handle frame with a mechanism to be attached to the top of a sack, a latching mechanism to keep the sack handle attached to the sack and a mechanism for placement of logos, brands, names or instructions. The sack handle provides a convenient and comfortable way to securely close and carry a sack. It is also very quickly and easily detachable from the sack.

1 Claim, 1 Drawing Sheet

REMOVABLE HINGED SACK HANDLE

BACKGROUND OF THE INVENTION

This sack handle is the result of a need for an inexpensive, simple, reusable and easily detachable closure and carrying device for a varity of sack sizes and materials such as paper, plastic or cloth and especially for, but not limited to, the lunch carring varieties. I don't believe the previously pattented products of this nature have the versatility of this sack handle. For example, the Tetradis patent is for a handle that can only be used on bags made of netting or open weave material. The J. Schmidt patent is an integral part of a plastic sack and can not be detached or used on another sack. Other handle patents such as the A. A. Schaaf and E. Arens are for a specific size or type of sack or package and do not have the versatility I feel is needed to accomodate the variety of sack sizes, materials and uses, required at the present time. My sack handle overcomes the short comings of the other patents because it functions equally well on a variety of said sizes and materials, does not damage the sack material and readily detaches from the sack.

SUMMARY OF THE INVENTION

The main functions of the sack handle are to provide a convenient and comfortable means for carrying a sack and to provide a location for logos, brands, names or instructions. Attached to one end of the trapazoid shaped handle frame by a thinned out hinge section, is a flat bar or rectangular cross sectional shape that functions to have the top of the sack rolled or folded around it. The flat bar has protruding ribs on both faces running lengthwise that mesh with protruding ribs on both corresponding surfaces of the handle frame. These ribs add rigidity and help secure the sack handle in place when attached to a sack. At the far end of the flat bar protrudes a short post with an enlarged tip that fundtions as the male portion of the latch.

Attached to the other end of the handle frame by a second thinned out hinge section is a semicircular shaped tab with a hole near the center thereof that is slightly smaller than the enlarged tip of the post. The tab, in conjunction with the hole, functions as the female portion of the latch.

The thinned out hinge sections are made so that the handle frame can be folded back on either side of the flat bar and the tab can be bent to either side. Thus making it possible to attach the sack handle to the sack from the left or the right side. Due to the simplicity of design, manufacture and use, I feel this sack handle is a significant improvement over similar existing products. It does not damage the sack, thus making it posible to reuse the sack many times. The semicircular shaped tab is large enough to make latching and unlatching easy but small enough to not be in the way during use. It can even be used on sacks wider than it by simply folding the top of the sack to make it the same width as th flat bar. To remove the sack handle, simply unlatch the semicircular shaped tab and slide the flat bar out of the rolled portion of the sack. The sack handle is easily and economically manufactured since it is a thin one piece part. There are no loose pieces to be assembled or get lost during use or storage. The plastic hinges are durable and will bend equally well in either direction.

BRIEF DECRIPTION OF THE DRAWING

FIG. 1 is a front view of the sack handle, unfolded.
FIG. 2 is a front view of the sack handle, folded.
FIG. 3 is an end view of the sack handle, folded.
FIG. 4 is a view of the sack handle attached to a sack.

DETAILED DESCRIPTION OF THE INVENTION

Figure 1:
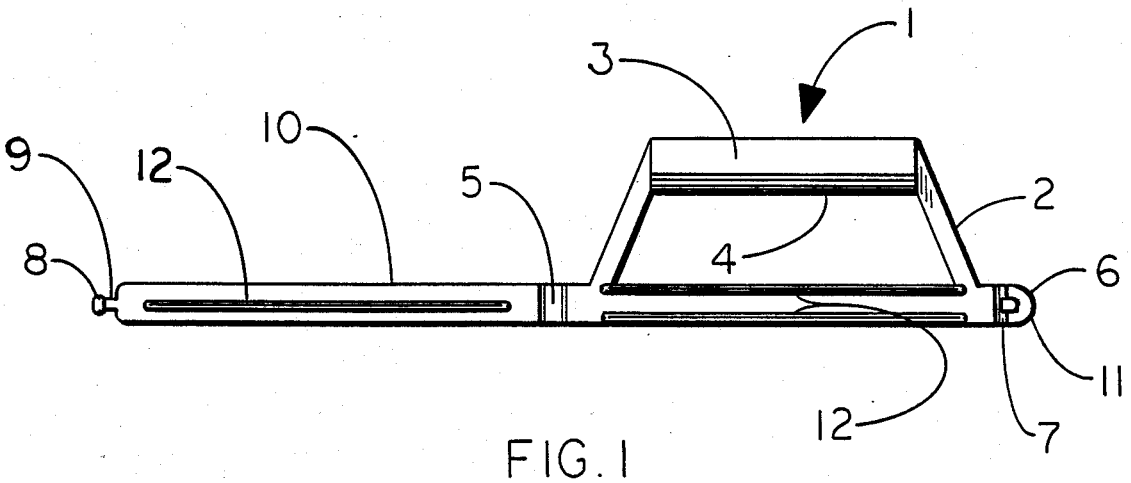
Figure 3:
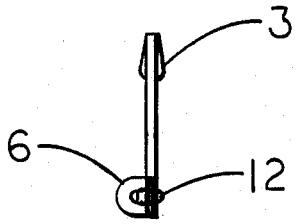
Figure 2:
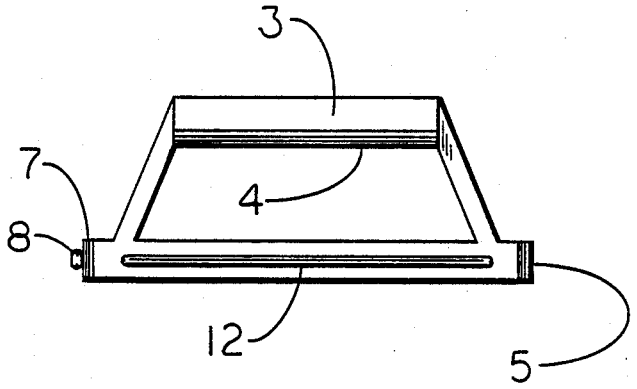
Figure 4:
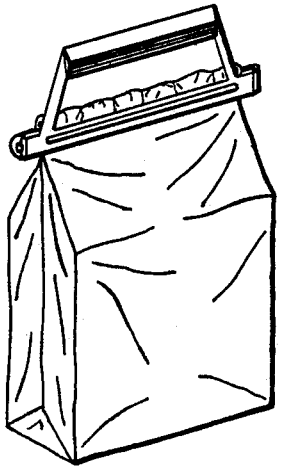

The sack handle according to the present invention is indicated generally at 1 in FIG. 1 and comprises a trapazoid shaped handle frame carrying member 2 having an enlarged portion 3 with a rounded edge 4 which is grasp by the user. Handle frame 2 which is bent or folded about hinge 5 is secured by folding or bending tab 6 about hinge 7 and snapping or latching tab 6 over the enlarged tip 8 of post 9 extending out from flat bar 10 as shown in figure 2 and FIG. 3. The enlarged tip 8 of post 9 is slightly larger than hole 11 in tab 6 so that tab 6 remains secured to post 9 unless intentionally unsnapping tab 6 from post 9. Ribs 12 are added for rigidity and help hold the sack handle in place on the sack. Although the sack handle 1 can be made of materials such as cardboard or fiber board, it is preferably made as a one piece molded part of a rigid thermo plastic material specially suited to make hinges 5 and 7. It will be understood that this invention is susceptible to modification in order to adapt it to different uses or conditions and accordingly it is desired to comprehend that such modifications are within the scope of the claims.

What is claimed is:

1. A one piece sack handle comprising a trapezoid shaped handle frame, said frame having two substantially parallel sides of uneven length, the shorter side comprising an enlarged curved handle portion, the longer side having a first end and a second opposite end and two spaced substantially parallel protruding ribs of substantially the same length as the longer side, a bar section being connected to and extending outwardly from said first end of said longer side by a first thinned out section, said first thinned out section comprising a first hinge, said bar section being of equal length and being parallel to the longer side, said bar section having a protruding rib thereon of substantially the same length as said bar section, a post having an enlarged tip extending outwardly from said bar section, a latching tab having a hole therein extending outwardly from the second end of and being substantially parallel to said longer side, said latching tab being connected to said second end by a second thinned out section, said second thinned out section comprising a second hinge, said hole being near the center of the tab and being slightly smaller than said enlarged tip of said post, said protruding ribs on said bar section and said longer section meshing with each other when said handle frame and said bar section are folded together about said first hinge, said tab being folded about the second hinge to engage over said post to secure said tab to said post when said handle frame and said bar section are in a meshing relationship for securely holding the handle on a sack.

* * * * *